US011154735B2

(12) United States Patent
Walker

(10) Patent No.: US 11,154,735 B2
(45) **Date of Patent: *Oct. 26, 2021**

(54) PERSONAL RESPIRATORY PROTECTION DEVICE

(71) Applicant: 3M INNOVATIVE PROPERTIES COMPANY, St. Paul, MN (US)

(72) Inventor: Garry J. Walker, Stockton-on-Tees (GB)

(73) Assignee: 3M Innovative Properties Company, St. Paul, MN (US)

( * ) Notice: Subject to any disclaimer, the term of this patent is extended or adjusted under 35 U.S.C. 154(b) by 791 days.

This patent is subject to a terminal disclaimer.

(21) Appl. No.: 14/911,124

(22) PCT Filed: Aug. 13, 2014

(86) PCT No.: PCT/US2014/050847

§ 371 (c)(1),
(2) Date: Feb. 9, 2016

(87) PCT Pub. No.: WO2015/026593

PCT Pub. Date: Feb. 26, 2015

(65) Prior Publication Data

US 2016/0193486 A1 Jul. 7, 2016

(30) Foreign Application Priority Data

Aug. 20, 2013 (GB) ..... 1314884

(51) Int. Cl.

| | |
|---|---|
| ***A62B 23/02*** | (2006.01) |
| ***A41D 13/11*** | (2006.01) |
| ***A62B 18/02*** | (2006.01) |

(52) U.S. Cl.
CPC ..... *A62B 23/025* (2013.01); *A41D 13/1146* (2013.01); *A41D 13/1161* (2013.01); *A62B 18/02* (2013.01); *A41D 13/1138* (2013.01)

(58) Field of Classification Search
CPC ... A62B 23/025; A62B 18/02; A41D 13/1146; A41D 13/1161; A41D 13/1138
See application file for complete search history.

(56) References Cited

U.S. PATENT DOCUMENTS 3,779,244 A 12/1973 Weeks, Jr.
3,888,246 A 6/1975 Lauer
(Continued)

FOREIGN PATENT DOCUMENTS

BR 9101774 11/1992
BR 9102774 1/1993
(Continued)

OTHER PUBLICATIONS

International Search Report for PCT International Application No. PCT/US2014/050847, dated Nov. 28, 2014, 4 pages.
(Continued)

*Primary Examiner* — Joseph D. Boecker
*Assistant Examiner* — Jonathan S Paciorek
(74) *Attorney, Agent, or Firm* — Steven A. Bern

(57) ABSTRACT

The present invention relates to a personal respiratory protection device, in particular, such a device comprising a respirator body having a periphery, a filter media, forming at least part of the respirator body, and a gasket, the gasket being located at the periphery and extending along at least a portion of its length.

19 Claims, 2 Drawing Sheets

(56) References Cited

U.S. PATENT DOCUMENTS 3,890,966 A 6/1975 Aspelin
4,030,493 A 6/1977 Walters
4,319,567 A 3/1982 Magidson
4,384,577 A 5/1983 Huber
4,419,993 A 12/1983 Peterson
4,454,881 A * 6/1984 Huber ..... A41D 13/1146 128/206.15
4,467,073 A 8/1984 Creasy
4,616,647 A 10/1986 McCreadie
4,635,628 A 1/1987 Hubbard
4,739,755 A 4/1988 White
4,790,306 A 12/1988 Braun
4,802,473 A 2/1989 Hubbard
4,827,924 A 5/1989 Japuntich
4,850,347 A 7/1989 Skov
4,873,972 A 10/1989 Magidson
4,941,470 A 7/1990 Hubbard
5,062,421 A 11/1991 Burns
5,394,568 A 3/1995 Brostrom
5,505,197 A 4/1996 Scholey
5,553,608 A 9/1996 Reese
5,561,863 A 10/1996 Carlson, II
5,619,989 A 4/1997 Kruger
5,701,893 A 12/1997 Kern
5,724,964 A 3/1998 Brunson
5,813,398 A 9/1998 Baird
5,836,303 A 11/1998 Hurst
5,918,598 A 7/1999 Belfer
D413,166 S 8/1999 Snow
6,044,842 A 4/2000 Pereira
6,055,982 A * 5/2000 Brunson ..... A41D 13/1115 128/205.27
D442,276 S 5/2001 Geist
6,332,465 B1 12/2001 Xue
6,354,296 B1 3/2002 Baumann
6,532,598 B1 3/2003 Cardarelli
D478,660 S 8/2003 Mault
6,752,149 B2 6/2004 Gillespie
D493,523 S 7/2004 Barnett
6,817,362 B2 11/2004 Gelinas
6,988,500 B1 1/2006 Cox
7,036,507 B2 5/2006 Jensen
7,210,482 B2 5/2007 Huang
7,290,545 B2 11/2007 Kleman
D556,901 S 12/2007 Davidson
D558,331 S 12/2007 Davidson
D571,459 S 6/2008 D'Souza
D578,207 S 10/2008 D'Souza
D582,547 S 12/2008 Ungar
D588,689 S 3/2009 Guney
D591,857 S 5/2009 Peake
D591,858 S 5/2009 Peake
D594,111 S 6/2009 Reid
D597,201 S 7/2009 Brambilla
7,559,323 B2 7/2009 Hacke
D600,342 S 9/2009 D'Souza
7,686,018 B2 3/2010 Cerbini
7,703,456 B2 4/2010 Yahiaoui
7,725,948 B2 6/2010 Steindorf
7,802,572 B2 9/2010 Hahne
7,828,863 B2 11/2010 Lindstrom
D629,885 S 12/2010 Skulley
D630,315 S 1/2011 Masters
D639,419 S 6/2011 Eves
D640,011 S 6/2011 Teng
7,979,273 B2 7/2011 Haupt
D645,558 S 9/2011 Matula
9,895,503 B2 * 2/2018 Jones ..... A61M 16/06
2002/0005198 A1 1/2002 Kwok
2002/0056450 A1 5/2002 Lee
2003/0029454 A1 * 2/2003 Gelinas ..... A62B 18/025 128/205.27
2004/0226563 A1 11/2004 Xu
2004/0255946 A1 12/2004 Gerson
2004/0261798 A1 12/2004 Rimkus
2006/0005838 A1 * 1/2006 Magidson ..... A41D 13/1176 128/206.19
2006/0096598 A1 * 5/2006 Ho ..... A61M 16/06 128/206.24
2006/0130841 A1 6/2006 Spence
2006/0130842 A1 6/2006 Klemen
2006/0266364 A1 11/2006 Turdjian
2007/0039620 A1 2/2007 Sustello
2007/0101997 A1 5/2007 Chiesa
2008/0099022 A1 5/2008 Gebrewold
2008/0271737 A1 11/2008 Facer
2009/0000623 A1 * 1/2009 Lynch ..... A61M 16/0622 128/206.24
2009/0235934 A1 * 9/2009 Martin ..... A41D 13/1138 128/206.15
2009/0283096 A1 11/2009 Cerbini
2010/0065058 A1 3/2010 Ungar
2010/0154805 A1 6/2010 Duffy
2010/0199995 A1 8/2010 Howie
2011/0048426 A1 3/2011 Sleeper
2011/0100370 A1 5/2011 Rose
2012/0060843 A1 * 3/2012 Magidson ..... A41D 13/1115 128/206.19
2012/0318272 A1 12/2012 Ho
2013/0146060 A1 * 6/2013 Ho ..... A61M 16/06 128/205.25
2013/0213414 A1 8/2013 Park
2015/0128936 A1 5/2015 Flannigan

FOREIGN PATENT DOCUMENTS

CA 1296487 3/1992
CN 3638374 4/2007
CN 3650369 5/2007
CN 200994999 12/2007
CN 300716892 12/2007
CN 300719882 12/2007
CN 300885357 2/2009
CN 300891852 3/2009
CN 300894832 3/2009
CN 201260848 6/2009
CN 201260849 6/2009
CN 301035315 10/2009
CN 301058342 11/2009
CN 301058343 11/2009
CN 301068813 11/2009
CN 301068815 11/2009
CN 301073812 12/2009
CN 301100365 12/2009
CN 301131414 2/2010
CN 301131415 2/2010
CN 301131416 2/2010
CN 301141429 2/2010
CN 301141430 2/2010
CN 301168433 3/2010
CN 301177581 4/2010
CN 301204437 5/2010
CN 101791154 8/2010
CN 201543135 8/2010
CN 201754811 3/2011
CN 102008791 4/2011
CN 201798053 4/2011
CN 301555272 5/2011
CN 301613029 7/2011
DE 134327 2/1979
EM 000818208-0001 1/2008
EM 000818208-0002 1/2008
EM 000818208-0003 1/2008
EM 000818208-0004 1/2008
EM 000980248-0001 8/2008
EM 000980248-0002 8/2008
EM 000980248-0003 8/2008
EM 000980248-0004 8/2008
EM 001055669-0002 1/2009
EP 0602425 6/1994
EP 0814871 1/1998
EP 0934704 8/1999
EP 1614361 1/2006

(56) References Cited

FOREIGN PATENT DOCUMENTS

| | | |
|---|---|---|
| EP | 2298096 | 3/2011 |
| GB | 2027802 | 2/1980 |
| GB | 2092009 | 8/1982 |
| GB | 2163056 | 2/1986 |
| GB | 3010663 | 8/2003 |
| GB | 2426498 | 11/2006 |
| GB | 2446374 | 8/2008 |
| JP | H09-239050 | 9/1997 |
| JP | 2001-161843 | 6/2001 |
| JP | 3734660 | 7/2001 |
| JP | 2003-236000 | 8/2003 |
| JP | 2004-337563 | 12/2004 |
| JP | 2006-288650 | 10/2006 |
| JP | 2007-020983 | 2/2007 |
| JP | 2008-229217 | 10/2008 |
| JP | 2008-279101 | 11/2008 |
| JP | 2009-011709 | 1/2009 |
| JP | 2011-30706 | 2/2011 |
| KR | 2009-0056587 | 6/2009 |
| KR | 2009-0091274 | 8/2009 |
| KR | 2011-0024310 | 3/2011 |
| KR | 2011-0008148 | 8/2011 |
| SE | 454484 | 5/1988 |
| WO | WO 1999-30583 | 6/1999 |
| WO | WO 2003-085242 | 10/2003 |
| WO | WO 2004-101658 | 11/2004 |
| WO | WO 2005-089875 | 9/2005 |
| WO | WO 2005-099826 | 10/2005 |
| WO | WO 2006-113163 | 10/2006 |
| WO | WO 2006-113321 | 10/2006 |
| WO | WO 2007-010969 | 1/2007 |
| WO | WO 2009/029349 | 3/2009 |
| WO | WO 2009-029363 | 3/2009 |
| WO | WO 2009-062265 | 5/2009 |
| WO | WO 2010-062893 | 6/2010 |
| WO | WO 2015-026587 | 2/2015 |
| WO | WO 2015-026588 | 2/2015 |
| WO | WO 2015-026595 | 2/2015 |

OTHER PUBLICATIONS

International Search Report for PCT International Application No. PCT/US2014/050817, dated Nov. 28, 2014, 4 pages.

* cited by examiner

PERSONAL RESPIRATORY PROTECTION DEVICE

CROSS REFERENCE TO RELATED APPLICATIONS

This application is a national stage filing under 35 U.S.C. 371 of PCT/US2014/050847, filed Aug. 13, 2014, which claims priority to Great Britain Application No. 1314884.6, filed Aug. 20, 2013, the disclosure of which is incorporated by reference in its/their entirety herein.

BACKGROUND

Personal respiratory protection devices, also known as respirators or face masks are used in a wide variety of applications where it is desired to protect the human respiratory system from air borne particulates or noxious or unpleasant gases. Generally such respirators are in either a moulded cup-shape, such as those discussed in U.S. Pat. No. 4,827,924, or flat-folded format, such as those discussed in EP 814 871.

Moulded cup-shaped masks typically comprise at least one layer of a filter media supported by either an inner and/or an outer support shell. A gasket is provided around the inner edge of the cup-shape to ensure a good fit against the face of the wearer. The gasket is usually formed from a flexible material such that it moulds around the facial features of the wearer, providing a seal and good engagement between the mask and the face of the wearer. The quality of the fit of such respirators should be high, since it is essential that as much air as possible passes through the filter media and not around the edges of the respirator in use. Such respirators may also be provided with a valve to aid breathing.

The gasket itself is therefore a key factor in achieving reproducible, reliable fit of the respirator. Given the variation in facial features of wearers the gasket needs to be flexible enough and sized accordingly to fit around many different contours. One problematic area is around the nose of the wearer, where the respirator needs to fit closely and firmly against the skin to ensure minimal movement of the respirator during use as well as an airtight fit. To aid with fit, respirators are typically provided with a nose clip, such as a strip of metal, provided on the outer surface of the respirator and designed to be bent around the nose of the wearer to hold the respirator in place. One alternative to providing a nose-clip is to use a foamed in place gasket that fills the gap around the edge of the nose of the wearer, thus providing an improved fit. Such a solution is discussed in EP 1 614 361, where a rubber-like edge bead is moulded around the edge of the respirator, with deformable flanges included in the nasal region.

However, various issues may still arise with the use of a nose clip or other gasket: firstly, the inclusion of a nose clip may create additional manufacturing costs; secondly, the nose clip may be uncomfortable for some wearers since facial features and sizes vary greatly across the population of wearers; and thirdly, the fit achieved when not using a nose clip may be poorer in general without such close contact between the gasket and the skin of the wearer. Further, where fit is less than ideal, additional problems are encountered by wearers who also require eyewear to perform tasks, such as safety eyewear or prescription eyewear. For example, it may be difficult to wear safety glasses in the correct or a comfortable position if the base of the lenses or the frame impinges on the upper edge of the respirator or gasket. Even if worn in the correct position, a poorly fitting gasket encourages moist breath to escape the respirator and travel under the frame or lens of the eyewear, causing the eyewear to fog.

SUMMARY

It would be desirable therefore to be able to deal with all of these issues by providing a gasket that gives optimum fit for all facial types and sizes, at minimal cost increase compared with current products, or, ideally, at a lower manufacturing cost.

The present invention aims to address at least some of these issues by providing a personal respiratory protection device for use by a wearer, comprising: a respirator body having a periphery, a filter media, forming at least part of the respirator body, and a gasket, the gasket being located at the periphery and extending along at least a portion of its length, wherein the gasket is formed of a flexible elastomeric material and is contoured, the contour comprising a ridge that projects away from the periphery, and a flexion point, disposed on the ridge, about which the gasket is adapted to flex.

The flexibility of the gasket and the contouring create an adaptable structure that conforms easily and fully to the facial features of the wearer. The ridge enables accurate positioning of the gasket across the nose and cheekbones, preventing inward leakage of air during use. By flexing about a single point, the fit of the gasket is optimised.

Preferably, the ridge is provided with an indent, and the indent forms the flexion point. Preferably, the indent is adapted to accommodate the nose of a wearer.

The device may further comprise headband means to secure the personal respiratory device onto a wearer such that the gasket flexes and conforms to the facial features of the wearer. Preferably, the headband means are adjustable, such that when the adjustable headband means are adjusted the gasket flexes and conforms to the facial features of the wearer.

Preferably, the ridge is deformable such that the gasket fits substantially flush against the nose and cheeks of a wearer.

Preferably, the gasket extends along substantially the entire periphery.

Preferably, the gasket fits substantially flush against the nose, cheeks and chin of a wearer.

Preferably the ridge is formed from a local increase in thickness of elastomeric material. Preferably, the flexion point is formed from a local reduction in thickness of elastomeric material. The ridge is preferably formed in the region of the gasket that contacts the nose of a wearer during use.

The contour may be substantially V-shaped.

Preferably, the gasket comprises a thermoplastic elastomer (TPE). The gasket may be injection moulded.

The filter media may be in the form of a cover, and the respirator body may comprise an inner cup shaped support and the filter media is overlaid on the inner cup shaped support. The cover and the inner cup shaped support may be joined at the periphery of the respirator body. The respirator body may comprise at least two panels.

Preferably, the gasket extends along the entire periphery of the respirator body.

Preferably, the device is a maintenance-free respirator device.

Preferably, the gasket comprises a sheet-like elastomeric material.

The gasket may be provided with an aperture adapted to accommodate the nose and mouth of a wearer.

BRIEF DESCRIPTION OF THE DRAWINGS

The present invention will now be described by way of example only, and with reference to the accompanying drawings, in which.

DETAILED DESCRIPTION

To create an improved fit without the use of nose clips, and to avoid issues resulting from poor fit, such as misting of eyewear, the present invention employs a contoured gasket formed from a flexible, elastomeric material. The gasket is attached to the periphery of the personal respiratory device, and extends along at least a portion of its length. The contour comprises a ridge that projects away from the periphery, and a flexion point, disposed on the ridge, about which the gasket is adapted to flex. This flexibility enables the gasket to deform around the nose, cheeks and chin of a wearer, ensuring contact with the skin at all points along the gasket and therefore around the periphery of the device where it extends. Preferably the gasket extends along the entire periphery, thus creating an extremely good fit, regardless of the shape and size of the wearers' facial features.

Figure 1:
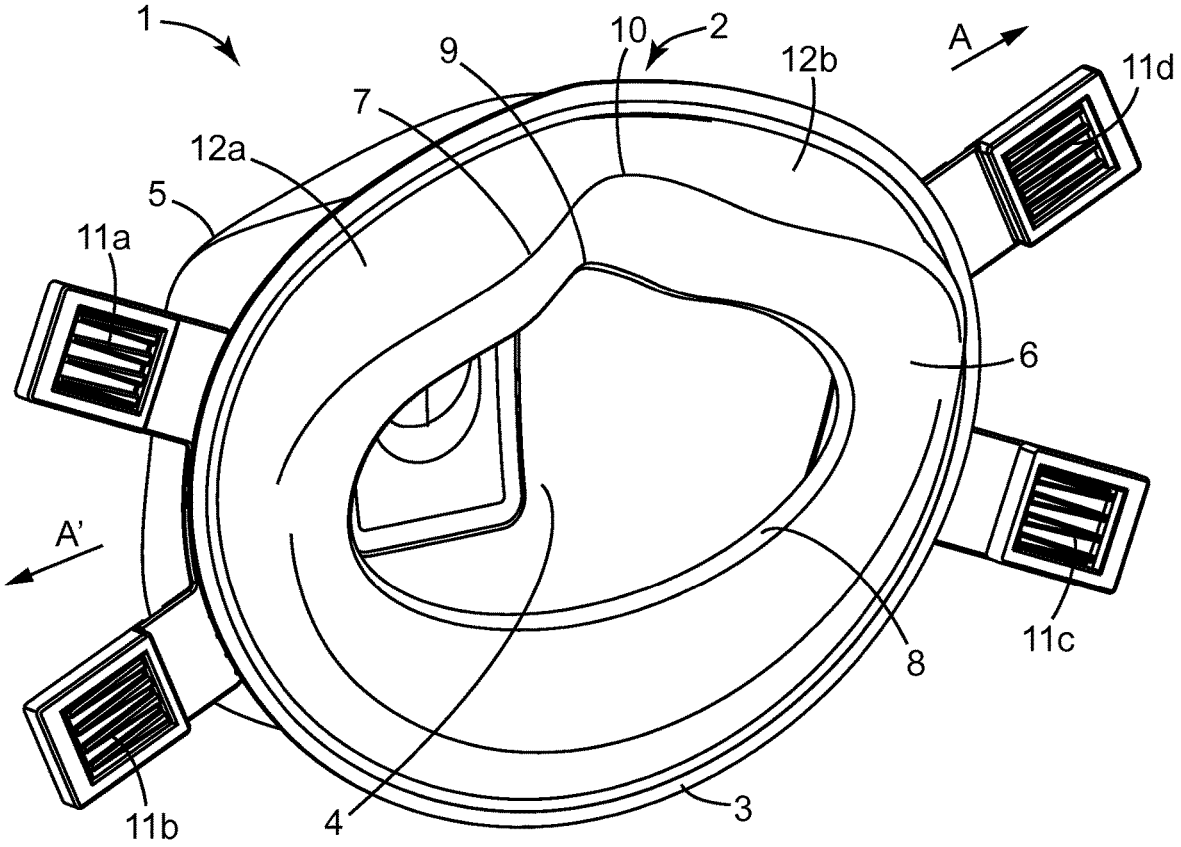
FIG. 1 is a perspective view of a personal respiratory device comprising a gasket in accordance with the present invention.

FIG. 1 is a perspective view of a personal respiratory device comprising a gasket in accordance with the present invention. The personal respiratory device 1 is generally cup-shaped, with a respirator body 2 having a periphery 3, and comprises an inner cup-shaped support 4 and a filter media in the form of an outer cover 5, the filter media being overlaid on the inner cup-shaped support 4, forming at least part of the respirator body 2. A gasket 6 is provided at the periphery 3 of the device 1, and in this embodiment extends around the entire periphery 3 of the device 1. The gasket 6 is formed from a flexible elastomeric material. The gasket 6 is contoured, as illustrated by the contoured region, with the contour comprising a ridge 7 that projects away from the periphery 3. The contour is substantially V-shaped. The ridge 7 is formed in the region of the gasket 6 that contacts the nose of the wearer during use, and is formed from a local increase in thickness of the elastomeric material of the gasket 6. The gasket 6 forms a central aperture 8, substantially elliptical in shape, for receiving the oro-nasal region of the wearer, such that the gasket 6 contacts the nose, cheeks and chin of the wearer. At the uppermost point, where, in use, the gasket 6 contacts the bridge of the nose of the wearer, the gasket 6 is provided with an indent 9. The indent 9 is adapted to accommodate the nose of the wearer. A flexion point 10 is disposed on the ridge 7, generally corresponding with the position of the indent 9, such that the indent 9 forms the flexion point 10. The flexion point 10 is formed from a local reduction in thickness of the elastomeric material of the gasket 6. The gasket 6 is adapted to flex about this flexion point 10.

Headband means 11*a-d* are provided to secure the device 1 onto a wearer such that the gasket 6 flexes and conforms to the facial features of the wearer. The headband means 11*a-d* are secured to the device 1 at the periphery 3 by means of ultrasonic welding. An additional lip may be provided at the periphery 3, extending around at least a part, preferably all of, the periphery, forming a base to which the headband means 11*a-d* may be attached, if desired. Preferably the headband means 11*a-d* are welded to the periphery 3, by means of ultrasonic welding, although other suitable and equivalent techniques may be used. The headband means 11*a-d* are adjustable such that when they are adjusted the gasket 6 flexes and conforms to the facial features of the wearer. When the adjustable headband means 11*a-d* are pulled tight, the gasket 6 flexes towards the face of the wearer, about the flexion point 10, pulling the indent 9 into contact with the nose. The headband means 11*a-d* each comprise a plastic buckle, through which a length of elastic material is threaded, and can be pulled through to be lengthened and shortened as desired. Two head bands (not shown) join each of two buckles, the head bands being formed from widths of elastic material. The structure of the buckle prevents easy movement in one direction thus holding the elastic material tightly in position. Alternatively, non-adjustable headband means may be used, such as strips of braided elastic, which may be glued, welded or stapled to the periphery 3.

The region of the gasket 6 at and adjacent the indent 9 contacts the nose and cheeks of the wearer intimately, creating a good fit. This is aided by the ridge 7 being deformable such that the gasket 6 fits substantially flush against the nose and cheeks of the wearer. In this example, the gasket 6 extends substantially the entire periphery 3, such that the gasket 6 fits substantially flush against the nose, cheeks and chin of a wearer.

The inner cup-shaped support 4 is preferably formed from a thermally bonded polyester non-woven air-laid staple fibre material, although may optionally be polyolefin, polycarbonate, polyurethane, cellulose or combination thereof fibre material. The outer cover web 5 is preferably formed from spun bond polypropylene bi-component fibre non-woven materials. An inner cover web, not shown, may optionally be provided between the outer cover web 5 and inner cup-shaped support 4, and is preferably also formed from spun bond polypropylene bi-component fibre non-woven material. The inner-cup shaped support 4, outer cover web 5 and gasket 6 are welded together at the periphery 3. Preferably, ultrasonic welding is used, however, thermal and other welding techniques are equally suitable. Although in this embodiment of the present invention an internal cup-shaped support is used, it may be preferable to use a different type of support or for the support to be absent altogether. For example, an external cup-shaped support may be used, with an internal filter layer, forming the respirator body 2.

Figure 2:
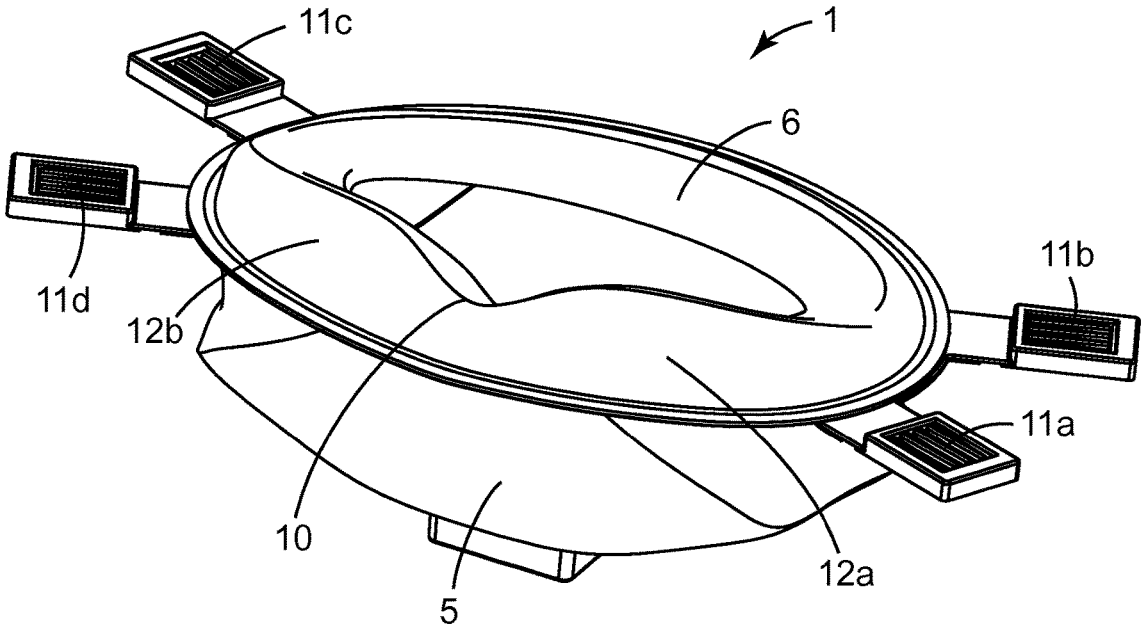
FIG. 2 is a side view of a personal respiratory device comprising a gasket in accordance with the present invention.

FIG. 2 is a side view of a personal respiratory device comprising a gasket in accordance with the present invention. This illustrates the shape of the contour in more detail. The contour is substantially V-shaped, with the apex of the "V" corresponding to the ridge 7. When the headband means 11*a-d* are pulled tight in the direction of arrows A, A', the gasket 6 flexes downwards at the flexion point pushing the regions 12*a*, 12*b* on either side of the flexion point 10 and indent 9 against the cheekbones of the wearer. The portion of the gasket 6 at the periphery 3 opposite the indent 9 is pulled tight against the chin of the wearer simultaneously. This creates an airtight fit around the entire periphery 3 of the device 1.

The gasket 6 is formed from a flexible elastomeric material, preferably a thermoplastic elastomer (TPE). Suitable materials include Evoprene® G 967 and G 953, both available from AlphaGary Limited, Beler Way, Leicester Road Industrial Estate, Melton Mowbray, Leicestershire LE13 0DG, UK. Preferably the thermoplastic elastomer material is injection moulded to create the gasket 6. A two-part mould is preferably pressure-filled from at least one injection point on the face of the mould, resulting in the final gasket 6 having the at least one injection point on a surface, rather than an edge. Injecting onto the face of the mould, rather than into an edge, results in excellent resistance to tearing and mechanical strength of the finished gasket 6.

Figure 3:
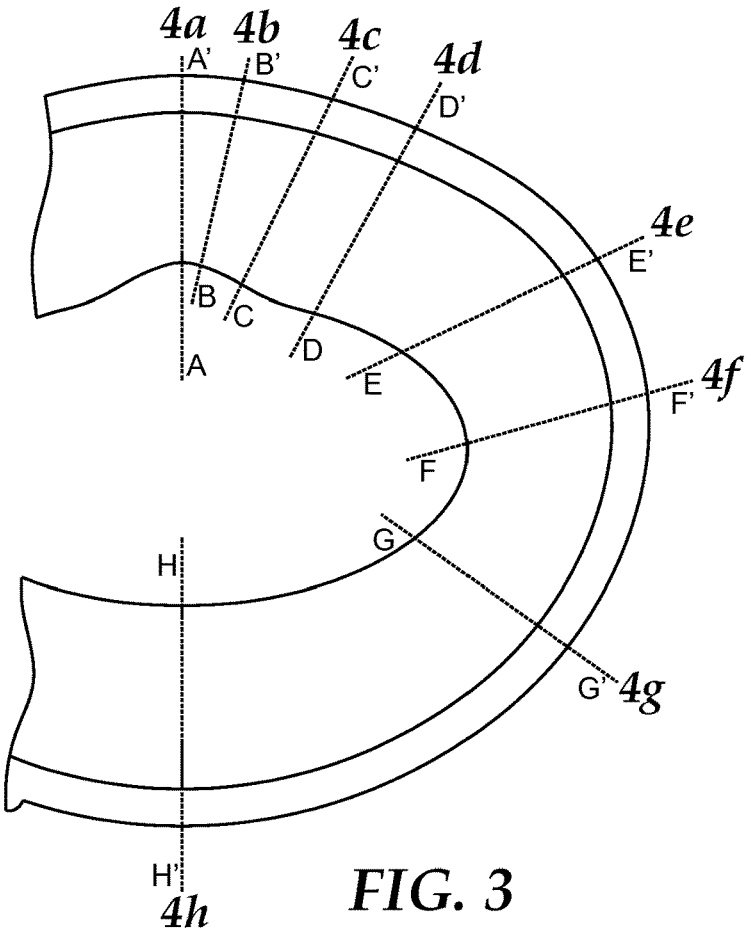
FIG. 3 is a plan view of a gasket indicating a number of cross-sections.
Figure 4A:
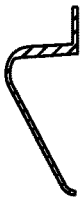
FIG. 4*a* is a cross-section along A-A' in FIG. 3

FIG. 3 is a plan view of a gasket indicating a number of cross-sections. These cross-sections show the contour and ridge 7 in more detail. FIG. 3 shows one half of the gasket 6, and it should be understood that the contouring on the half not shown is a mirror image of that in cross-sections A-A' to H-H'. FIG. 4*a* is a cross-section along A-A' in FIG. 3, and shows the thickness of the gasket 6 at the region of the indent 9 and flexion point 10. Although the nominal thicknesses below are given, these should be understood to be preferred values within a range determined by manufacturing tolerances of ±0.2 mm. In addition, both the nominal values and tolerances may change with the grade and composition of the TPE material used to manufacture the gasket 6.

Figure 4B:
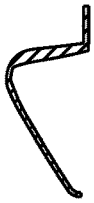
FIG. 4*b* is a cross-section along B-B' in FIG. 3.
Figure 4C:
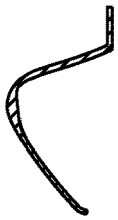
FIG. 4*c* is a cross-section along C-C' in FIG. 3.
Figure 4D:
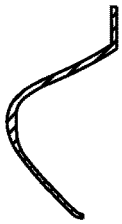
FIG. 4*d* is a cross-section along D-D' in FIG. 3.
Figure 4E:
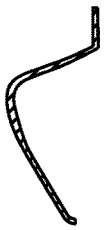
FIG. 4*e* is a cross-section along E-E' in FIG. 3.
Figure 4F:
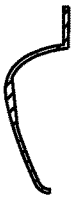
FIG. 4*f* is a cross-section along F-F' in FIG. 3.
Figure 4G:
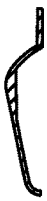
FIG. 4*g* is a cross-section along G-G' in FIG. 3.
Figure 4H:
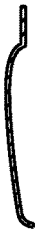
FIG. 4*h* is a cross-section along H-H' in FIG. 3.

The gasket 6 has a nominal thickness of 1.67 mm in the region of the ridge 7, 0.80 mm at the periphery 3 and 0.65 mm at the remainder of the gasket 6. Hence the ridge 7 is formed by a local increase in thickness of the elastomeric material. FIG. 4*b* is a cross-section along B-B' in FIG. 3, and FIG. 4*c* is a cross-section along C-C' in FIG. 3. Here the nominal thickness of the gasket 6 at the ridge 7 is 2.04 mm and 1.73 mm respectively, indicating that the flexion point is formed from a local reduction in thickness of the elastomeric material. The thickness of the material forming the ridge 7 decreases moving away from the indent 9, as indicated in FIGS. 4*d* (1.50 mm) and 4*e* (1.14 mm). Where the ridge 7 is angled towards the periphery 3 at sections F-F' and G-G', as shown in FIGS. 4*f* and 4*g*, the thickness increases slightly (1.34 mm and 1.67 mm respectively), where the gasket 6 contacts the jawbone of the wearer around the edges of the mouth. Finally, the portion of the gasket 6 that fits across the chin of the wearer, as shown at section H-H' in FIG. 4*h*, has approximately the same nominal thickness as the remainder of the gasket away from the ridge 7 and periphery 3, that is 0.65 mm. From FIGS. 4*b* and 4*c* in particular it can be seen how the variation in thickness of the gasket 6 allows it to deform and contact the nose and cheeks of the wearer, yet remain structural enough at the ridge 7 to form an airtight seal. Unlike prior art devices, the gasket comprises a sheet-like elastomeric material, with the performance characteristics being determined by the variations in thickness of the material and contours formed by injection moulding.

EXAMPLES

In order to determine the effectiveness of the gasket, testing was carried out to measure the total inward leakage (TIL) of the device. This is where the leakage of air into the device from external surroundings due to a poor seal with the face of the wearer is tested, and is a measure of the quality of the fit of the device. The performance requirements in respect of total inward leakage are laid out in clause 7.9.1 of EN149:2001+A1:2009 for a class FFP3 device (filtering half mask). To test total inward leakage, test subjects don the device and adjust the fit accordingly to best fit their facial features, and perform a variety of tasks whilst wearing the device, in an atmosphere containing a particulate suspension (salt concentration inside the mask ratio to salt concentration outside the mask as %). The TIL is determined by the amount of particles present inside the device after use, as a measure of the leakage around the gasket and seal with the wearers' face. To meet the criteria of EN149:2001+A1:2009, a test panel of people with a variety of facial sizes is used, with the standard requiring that only 4 test subjects out of 10 should exceed a maximum permitted TIL value of 5%, and that the mean TIL value over all activities should not exceed 2% for any test subject. The test activities included: a walk, moving head side-to-side, moving head up and down, talking and a second walk. Out of 10 subjects tested, none exceeded the 5% maximum or the 2% mean value, such that the device in accordance with the present invention met the requirements of the standard.

In the above example, the device 1 is cup-shaped, with the gasket 6 extending along the entire periphery 3 of the respirator body 2. However, it may be desirable to include the gasket on a device that is not cup-shaped. For example, the respirator body 2 may comprise at least two panels, thus forming a flat fold respirator device. In either case, the device 1 may also include a valve 15. Preferably, the device 1 is a maintenance-free respirator device. Alternatively, the device may be a reusable respirator.

The invention claimed is:

1. Personal respiratory protection device for use by a wearer, comprising:

a respirator body having a periphery, a filter media forming at least part of the respirator body, and a gasket, the gasket being located at the periphery and extending along its length, wherein the gasket includes at least nose and cheek regions and forms a central aperture, wherein the gasket is formed of a flexible elastomeric material and is contoured, the contour comprising a ridge that projects away from the periphery and the central aperture, and a flexion point, disposed on the ridge, about which the gasket is adapted to flex and thus bring the gasket, including the nose and cheek regions into intimate contact with the nose and cheeks of a wearer, wherein the flexion point is formed from a local reduction in thickness of the flexible elastomeric material;

wherein at least a portion of the ridge is angled towards the periphery, and further wherein the ridge is adapted to deform against the face of the wearer.

2. Device of claim 1, wherein the ridge is provided with an indent, and the indent forms the flexion point.

3. Device of claim 2, wherein the indent is adapted to accommodate the nose of the wearer.

4. Device of claim 1, further comprising headband means to secure the personal respiratory device onto wearer such that the gasket flexes and conforms to the facial features of the wearer.

5. Device of claim 4, wherein the headband means are adjustable, such that when the adjustable headband means are adjusted the gasket flexes and conforms to the facial features of the wearer.

6. Device of claim 1, wherein the ridge is deformable such that the gasket fits substantially flush against the nose and cheeks of the wearer.

7. Device of claim 1, wherein the gasket extends along substantially the entire periphery.

8. Device of claim 7, wherein the gasket fits substantially flush against the nose, cheeks and chin of the wearer.

9. Device of claim 1, wherein the ridge is formed from a local increase in thickness of elastomeric material.

10. Device of claim 1, wherein the ridge is formed in the region of the gasket that contacts the nose of the wearer during use.

11. Device of claim 1, wherein the contour is substantially V-shaped.

12. Device of claim 1, wherein the gasket comprises a thermoplastic elastomer (TPE).

13. Device of claim 12, wherein the gasket is injection moulded.

14. Device of claim 1, wherein the filter media is in the form of a cover, and the respirator body comprises an inner cup shaped support and the filter media is overlaid on the inner cup shaped support.

15. Device of claim 14, wherein the cover and the inner cup shaped support are joined at the periphery of the respirator body.

16. Device of claim 1, wherein the gasket extends along the entire periphery of the respirator body.

17. Device of claim 1, wherein the gasket comprises a sheet-like elastomeric material.

18. Device of claim 1, wherein the central aperture of the gasket is adapted to accommodate the nose and mouth of wearer.

19. The device of claim 1, further comprising a headband to secure the personal respiratory device onto the wearer such that the gasket flexes downwards at the flexion point to conform to the facial features of the wearer.

* * * * *